United States Patent [19]

Badger

[11] 4,289,010

[45] Sep. 15, 1981

[54] UNIVERSAL ADAPTER FOR SCREW ANCHOR INSTALLATION

[75] Inventor: Dale R. Badger, 7609 W. Heatherbrae, Phoenix, Ariz. 85033

[73] Assignees: Dale R. Badger; Spencer Norman, both of Phoenix, Ariz.

[21] Appl. No.: 148,921

[22] Filed: May 12, 1980

[51] Int. Cl.[3] ..... B21J 15/34

[52] U.S. Cl. ..... 72/114; 72/391

[58] Field of Search ..... 72/114, 391, 454; 29/243.53, 243.54

[56] References Cited

U.S. PATENT DOCUMENTS

| | | | |
|---|---|---|---|
| 2,069,907 | 2/1937 | Waner | 72/391 |
| 2,188,422 | 1/1940 | Waner | 72/391 |
| 2,283,665 | 5/1942 | Cadden | 72/391 |
| 2,284,347 | 9/1945 | Schutz | 72/391 |
| 2,399,442 | 4/1946 | Luce | 72/391 |
| 2,437,191 | 3/1948 | Gill | 72/114 |
| 3,031,098 | 4/1962 | Croessant | 72/391 |
| 3,561,249 | 2/1971 | Freeman | 72/391 |
| 3,933,019 | 1/1976 | Underland | 72/114 |
| 4,147,047 | 4/1979 | Fluester | 72/114 |

*Primary Examiner*—Gene P. Crosby

*Attorney, Agent, or Firm*—LaValle D. Ptak

[57] ABSTRACT

An adapter for use with a conventional installation tool normally used for installing blind rivets comprises a universal installer head which is attached to the tool by threading one end of it onto the head of the tool in alignment with the gripping and pulling jaws located within the tool. The other end of the installer head is made to engage the upper surface of a squash nut. A pull shaft has a threaded end for engagement with the internally threaded portion of a squash nut and a jaw engaging end for free passage through the hole in the installer head into the area within the tool where it is gripped and pulled by the jaws in the installation tool. For squash nuts of different sizes, different pull shafts may be used where the jaw engaging end is of the same external diameter but where the threaded end has a different size depending upon the size of the squash nut with which the pull shaft is intended to be used. The pull shaft is made to be fully released by the tool following the installation of each squash nut; so that it may be manually removed from an installed squash nut and manually inserted into the next squash nut to be installed, whereupon the tool with the universal installer head is placed over the jaw engaging end of the pull shaft to install the next squash nut.

7 Claims, 7 Drawing Figures

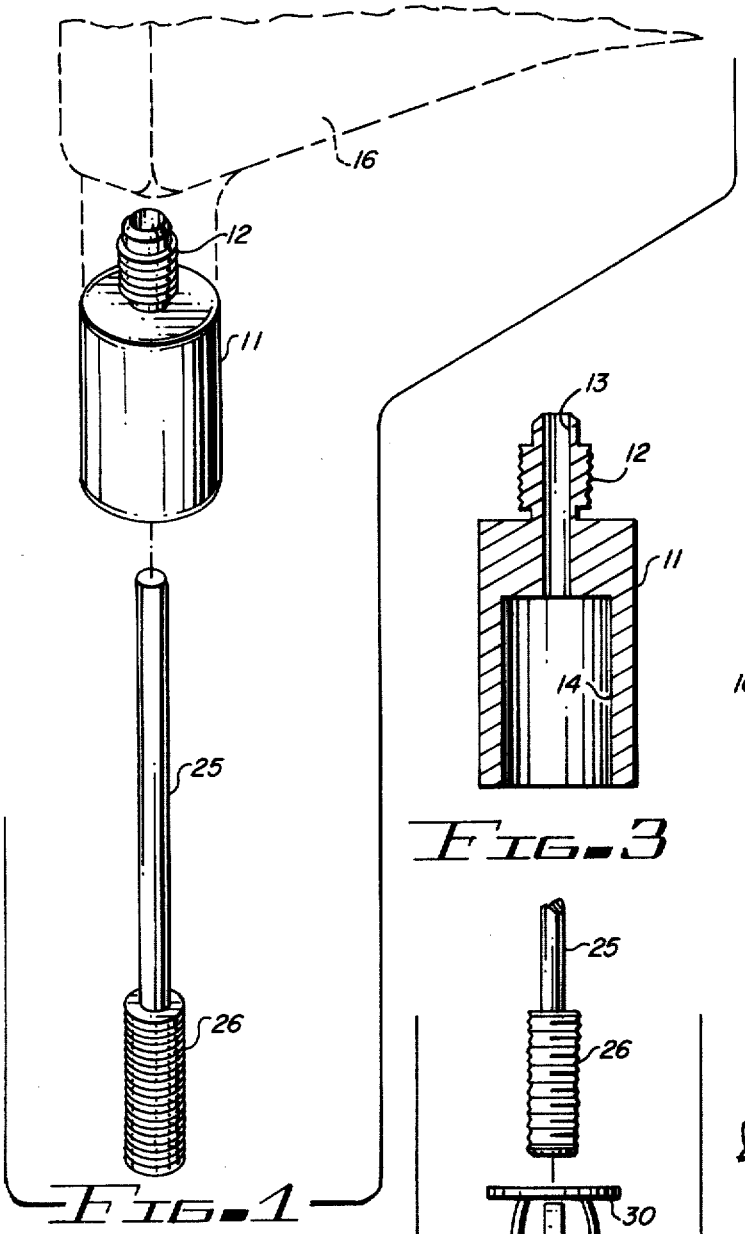
FIG. 1
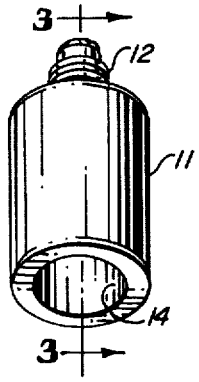
FIG. 2
FIG. 3
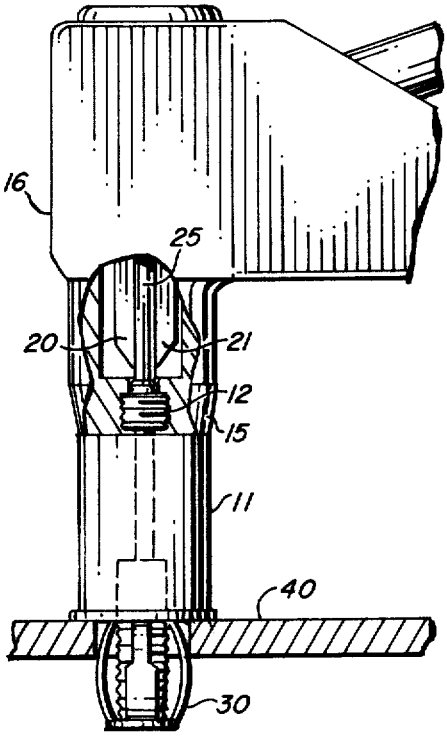
FIG. 5
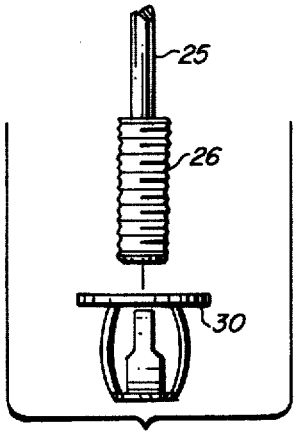
FIG. 4
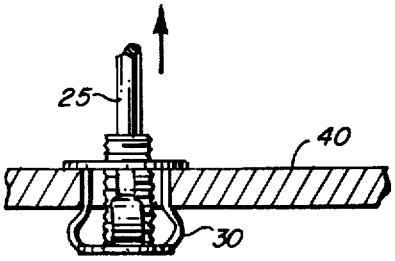
FIG. 6
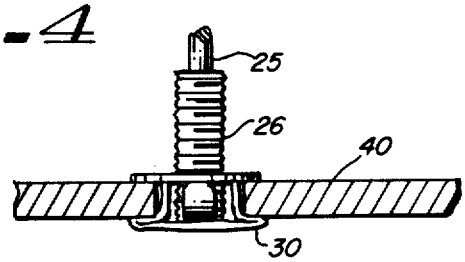
FIG. 7

UNIVERSAL ADAPTER FOR SCREW ANCHOR INSTALLATION

BACKGROUND OF THE INVENTION

A variety of applications exist for installing threaded screw anchors or squash nuts in sheet metal panels, walls, and other surfaces for a variety of purposes. Generally, such threaded screw anchors or squash nuts are installed from the outer surface only and include collapsable legs extending through a hole in the panel or wall surface to a preestablished distance on the blind or opposite side. These legs terminate in a threaded end portion; so that when a screw is inserted into the squash nut and turned, the action of the screw working against the head pressing on the outer flange of the squash nut causes the collapsable legs to collapse outwardly and grip the panel on the reverse side. Normally, such squash nuts are installed by hand using a manually operated screw driver or, in some cases, a power-driven screw driver. A relatively large number of turns of the screw, which is inserted into the squash nut, however, is necessary to collapse the squash nut onto the reverse side of the panel in which it is installed. Then it is necessary to reverse the screw by the same number of turns to remove it. Consequently, even if a power-driven screw driver is used, the time required for the installation of the squash nut is relatively long. If the squash nut is collapsed manually, the length of time for this operation is even greater.

In an effort to facilitate the installation of threaded screw anchors or squash nuts in a more rapid fashion than is possible with the insertion, turning and subsequent removal of a screw of the type normally associated with such squash nuts, various types of hand-tools have been developed in the past. These tools generally resemble tools of the type used for installing tubular rivets of the collapsable type in various surfaces. A typical tool is disclosed in the Croessant U.S. Pat. No. 3,031,098, issued Apr. 24, 1962. This patent discloses a tool used to install blind screw anchors in which a detachable pull rod extends through the tool body. One end of the rod has a knurled knob attached to it and the other end is threaded for engagement with the threaded portion of a threaded screw anchor. A spring is provided inside the tool and the knob is turned several turns to wind-up the spring, placing it under tension. A threaded screw anchor then is threaded onto the threaded end of the pull rod, and the anchor installed on the tool then is pushed into a hole in the plate or other surface in which the anchor is to be mounted. A pliers-type of action is provided for drawing the pull rod into the tool relative to the end of the tool pressing against the outer flange of the squash nut to collapse the squash nut and clamp it onto the plate into which it has been inserted. Release of the handles then releases the spring to unwind or unthread the pull rod; so that the operation can be repeated. This tool is a relatively cumbersome tool to use because of the necessity for the winding-up the spring and the number of different steps which must be undertaken in order to use the tool.

Another tool which has been developed for setting threaded bushes also uses a pliers-type of squeeze handle operation for inserting and collapsing threaded bushes by using a pull rod type of action. This tool is disclosed in the U.S. Pat. to Fluester, No. 4,147,047, issued Apr. 3, 1979. The mandrel or pull rod is fixed to a mandrel puller within the tool which is rotatably and slidably mounted in a body portion of the tool. When the tool is operated, the mandrel puller is pulled into the tool; so that the threaded bush strikes the body portion, is held and then is expanded upon further movement of the mandrel puller. The threaded bush is released by rotating the mandrel puller relative to the body portion by rotating a knurled knob on the opposite end of the mandrel puller which extends through the operating head portion of the tool. The nature of this arrangement is one which is cumbersome and relatively difficult to use. The tool does constitute an improvement over the use of a screw and screw driver to collapse the threaded bush, however.

Several other patents for rivet tools employ similar constructions to the devices described above in conjunction with the Croessant and Fluester patents. These additional patents, however, all are subject ot disadvantages in operation of the nature of the disadvantages discussed above in conjunction with Croessant and Fluester. Such rivet tools are disclosed in the U.S. Pats. to Underland No. 3,933,019, issued Jan. 20, 1976; Waner No. 2,069,907 issued Feb. 9, 1937; Warner, No. 2,188,422, issued Jan. 30, 1940; and Caddin, No. 2,283,665, issued May 19, 1942.

It is desirable to provide an adapter which can be used in conjunction with a conventional squeeze-type rivet installation tool to modify such a gun for the purpose of enabling it to apply and attach threaded bushes or squash nuts in plate metal surfaces, and the like. It is further desirable that such an adapter should be simple to construct and simple to operate; so that rapid installation of squash nuts by the use of a hand-operated rivet installation tool employing the adapter is possible.

SUMMARY OF THE INVENTION

Accordingly, it is an object of this invention to provide an improved tool for installing squash nuts and the like in a plate, wall, or other surface.

It is another object of this invention to provide an improved squash nut installation method.

It is an additional object of this invention to provide an adapter for a standard rivet installation tool to permit it to be used for installing squash nuts, and the like.

It is a further object of this invention to provide an adapter for a standard manually-operated rivet installation tool to permit such a tool to be used to install squash nuts of various sizes.

It is yet another object of this invention to provide an improved apparatus for permitting the rapid installation of squash nuts and threaded fasteners in metal plates, and the like.

In accordance with a preferred embodiment of this invention, an adapter is provided for modifying an installation tool of the type used to install blind rivets. Such a tool has internal jaws for gripping and pulling on a pull shaft inserted between the jaws in an operation of the tool. The adapter modifies the tool from one for installing blind rivets to one for installing squash nuts, and the like. The adapter comprises two parts, namely a universal installer head for connection to the end of the rivet gun, and a pull shaft. The head has a longitudinal hole through it in alignment with the internal jaws of the tool to permit free passage of the pull shaft through the head. One end of the pull shaft is threaded for engagement with a squash nut. The pull shaft also has a jaw engaging end for passage through the hole in the installer head to a position in the installation tool where the jaw engaging end may be gripped and pulled by the jaws in the installation tool. In operation, the pull shaft is released upon completion of the installation; so that it readily can be removed and used in the installation of another squash nut.

BRIEF DESCRIPTION OF THE DRAWING

FIG. 1 is a perspective view of a perferred embodiment of this invention;

FIG. 2 is another perspective view of a portion of the embodiment shown in FIG. 1;

FIG. 3 is a cut-away view of the portion shown in FIG. 2;

FIG. 4 illustrates a portion of the embodiment of FIG. 1 used in conjunction with the installation of a squash nut;

FIG. 5 illustrates application of the embodiment of FIG. 1 in conjunction with a tool to which the adapter is attached; and FIGS. 6 and 7 illustrate various stages in the operation of the tool and adapter shown in FIGS. 1 through 5.

DETAILED DESCRIPTION

Referring now to the drawing, the same reference numbers are used throughout the different figures to designate the same or similar components. FIG. 1 is an exploded view showing the component parts of a preferred embodiment of the invention as used in conjunction with a standard, manually-operated, squeeze handle-type of rivet gun or installation tool (shown in dotted lines), which typically may be a model HP-2 rivet installation tool of the type manufactured by the Marson Corporation and sold under the trademark "Klik Fast". The parts shown in FIG. 1 are used to modify such a standard rivet installation tool to permit it to be used to install squash nuts or collapsable screw anchors. To accomplish this purpose, a universal installer head 11 is provided with an externally threaded extension 12 dimensioned to be threaded into a mating internally threaded opening in the head 15 of a standard rivet installation tool 16 of the type described above. This connection of the installer head 11 to the head 15 of the tool 16 is shown most clearly in FIG. 5.

The installer head 11 is of a generally cylindrical shape, having a longitudinal cylindrical hole 13 passing through it for alingment with a pair of gripping and pulling jaws 20 and 21 (FIG. 5) located within the rivet installation tool 16 with which the installer head 11 is used. The lower end of the installer head 11 has an enlarged cylindrical cavity 14 in it, as shown most clearly in FIGS. 2 and 3.

The other portion of the adapter assembly for use with the rivet installation tool 16 comprises an elongated cylindrical pull shaft 25 terminating at its lower end in a threaded portion 26. The threaded portion 26 is an externally threaded end on the pull shaft 25 which threadedly engages the internal threads of the particular size of squash nut which is to be installed by use of the pull shaft 25. The upper portion of the pull shaft 25, that is the non-threaded portion, is dimensioned to freely pass through the cylindrical hole 13 through the upper portion of the installer head 11. The shaft 25 slides vertically (as the parts are arranged in the various figures of the drawing) in the longitudinal opening 13, essentially without constraint. The enlarged cavity 14 is selected to be of a sufficient depth and sufficient diameter to permit all or a portion of the threaded end 26 on a pull shaft 25 to be pulled up into the cavity 14 to a point where a squash nut or threaded fastener is fully installed in a plate without any interference with any part of the installer head 11.

Since threaded inserts or squash nuts come in various sizes depending upon the ultimate use which is to be made of such squash nuts, pull shafts 25 having various diameters of threaded ends 26 on them may be universally used with a single adapter head 11. The smooth or uppor portion of the shaft of all of the different pull shafts 25 is a rod of the same diameter. Thus, the alignment of the pull shafts 25 is accomplished by means of the longitudinal hole 13 through the upper portion of each of the head 11 by virtue of the relatively close tolerances between the internal diameter of the hole 13 and the external diameter of the upper end of the pull shaft 25. Since the alignment is accomplished by means of this portion of the installer head, the internal diameter of the cavity 14 may be selected to be slightly in excess of the largest external diameter of the threaded portion 26 of any pull shaft which may be used in conjunction with the tool. In some cases, for example, the external threaded portion 26 of the pull shaft 25 could even be smaller than the external diameter of the upper end of the pull shaft 25, ranging upwards to a diameter of several times the diameter of the upper end of the pull shaft 25. Various pull shafts having different diameter threaded portions 26 all can be used with the same adapter head and the same rivet installation tool as desired, including interchangeably if necessary.

In the use of the adapter for modifying a blind rivet installation tool 16 to permit it to install squash nuts and screw anchors, a collapsable screw anchor or squash nut 30 first is manually threaded onto the threaded end 26 of a pull shaft having a threaded end 26 of a suitable diameter for engagement with the threaded portion of the squash nut 30. This initial step in the installation is illustrated in FIG. 4. Only one of two turns of the squash nut 30 on the threaded end 26 of the pull shaft 25 is necessary. This is quickly done by an operator simply spinning the shaft 25 between his fingers and he inserts the shaft into the threaded portion of the squash nut 30. The installation head 11 previously has been screwed into the threaded socket on the end 15 of the installation tool 16, thereby preparing the tool for use with the squash nut installer. The pull shaft 25 then is inserted through the opening 13 of the installer head 11 to a position between the jaws 20 and 21 located within the tool when the tool is in its relaxed or open position, spreading the jaws 20 and 21 apart. Slight pressure on the handles (not shown) of the installation tool to cause the jaws 20 and 21 to grip the shaft 25 then may be effected to hold the shaft and the squash nut 30 in place on the end of the installation head 11. When the squash nut 30 is thus held, it may be inserted through an opening in a plate 40 to the position shown in FIG. 5. Alternatively, the pull shaft 25 and squash nut 30 may be inserted into the plate 40 prior to the placement of the shaft 25 through the hole 13 to a position between the jaws 20 and 21 of the installation tool. This is at the option of the person using the tool, and the particular technique which is used is a matter of personal preference.

Once, however, the adapter and the tool 16 are assembled, as shown in FIG. 5, the tool then is operated in its conventional manner causing the jaws 20 and 21 to firmly grip the upper end of the shaft 25. As the tool handles are squeezed together, the jaws 20 and 21 move upwardly (as shown in FIG. 5) firmly pulling the pull shaft 25 upwardly with them. Obviously, the threaded end 26 also moves upwardly and pulls the bottom portion (as viewed in FIGS. 4, 5, 6 and 7) of the squash nut 30 upwardly relative to the upper flange of the squash nut, which is firmly held in place by the lower face of the installer head 11. This causes the squash nut 30 to commence collapsing, as indicated in FIG. 6. As the pull shaft 25 continues to be drawn upwardly to its maximum upward position, the squash nut 30 collapses firmly against the under side of the plate 40, securely clamping it in place on the plate in a conventional manner. After this has been accomplished, the jaws 20 and 21 are released, permitting the tool and installer head 11 to be withdrawn from the pull shaft 25. Following this, a simple counterclockwise rotation of the shaft 25 between the fingers of the operator effects its release from the squash nut 30 and prepares the adapter for use in the installation of another squash nut 30. At this point, since the tool 16 has been released from the shaft 25 of the adapter, a pull shaft having a different sized threaded end 26 on it may be used to install a different sized squash nut, if desired. No time is lost and no additional modification of the installation tool or the installer head 11 is necessary; so that the universal application of the tool permits its rapid and simple use in the installation of a large number of squash nuts of either the same or different sizes.

It should be noted that the adapter which has been described above and which is shown in the drawing is capable of use with installation tools of various types employing the "gripping jaw" principle of operation used in the specific tool which is illustrated in conjunction with the embodiment of the invention disclosed. The particular type of tool and the arrangement used within that tool for moving the pull shaft longitudinally along its axis is not a part of the invention since various types of mechanisms can be used to accomplish this purpose.

The embodiment which has been described and shown is to be considered illustrative of the features of the invention and not as limiting. Various modifications will occur to those skilled in the art without departing from the true scope of the invention. The adapter substantially reduces the time required for the installation of squash nuts or threaded screw anchors over the manual techniques commonly employed. Furthermore, because of its simplicity, the adapter is easy to operate and is essentially trouble-free because of its simplicity.

I claim:

1. An adapter for modifying an installation tool of the type used to install blind rivets and having internal jaws for gripping and pulling on a pull shaft inserted therebetween in the operation of such tool, said adapter modifying the tool from one for installing blind rivets to one for installing squash nuts and including in combination:

a universal installer head for connection to the tool and having a longitudinal hole therethrough in alignment with the internal jaws of the tool for permitting free passage of a pull shaft through said head; and a pull shaft having a threaded end for engagement with a squash nut and a jaw engaging end for passage through the hole in said head to a position in the tool where the jaw engaging end may be gripped and pulled by the jaws in the installation tool.

2. The combination according to claim 1 wherein said universal installer head has a threaded portion on one end thereof for matingly engaging a similar threaded portion on the tool and has an enlarged opening cooperating with the hole therethrough in the other end for permitting at least a portion of the threaded end of said pull shaft to be moved into and out of said head.

3. The combination according to claim 2 wherein the end of said installer head opposite the end attached to the tool has a squash nut head engaging surface for engaging and clamping the head of a squash nut when the tool pulls said pull shaft upwardly into it in the process of collapsing a squash nut to attach it to a plate.

4. The combination according to claim 2 wherein the longitudinal hole through said head is a cylindrical hole and the jaw engaging end of said pull shaft is a cylindrical rod having an external diameter less than the internal diameter of said hole to permit free passage into and out of the hole in said head.

5. The combination according to claim 2 wherein said universal installer head is usuable with pull shafts having threaded ends thereon in different sizes for engaging different sizes of squash nuts.

6. The combination according to claim 1 wherein release of the internal jaws of the tool releases said pull shaft from the tool while said head remains attached to the tool, so that said pull shaft readily may be inserted into a squash nut prior to collapse of such squash nut and readily may be removed from a squash nut independently of the tool and said head after collapse of the squash nut has been effected.

7. The combination according to claim 1 wherein said pull shaft may be engaged with and disengaged from the internally threaded portion of a squash nut independently of the insertion and removal of said pull shaft into and from said universal head and said tool.

* * * * *